United States Patent [19]

Adler

[11] 4,010,853

[45] Mar. 8, 1977

[54] DRAFT GEAR CARRIER FOR RAILWAY CARS

[75] Inventor: Franklin P. Adler, Michigan City, Ind.

[73] Assignee: Pullman Transport Leasing Company, Chicago, Ill.

[22] Filed: July 24, 1975

[21] Appl. No.: 599,238

[52] U.S. Cl. ..... 213/61

[51] Int. Cl.[2] ..... B61G 7/10; B61G 9/20

[58] Field of Search ..... 213/61, 60, 21, 8, 62–64, 213/67 R, 69

[56] References Cited

UNITED STATES PATENTS 1,065,646 6/1903 Westlake ..... 213/61

3,239,073 3/1966 Danielson et al. ..... 213/21

*Primary Examiner*—Robert B. Reeves
*Assistant Examiner*—John P. Shannon
*Attorney, Agent, or Firm*—Richard J. Myers

[57] ABSTRACT

A draft gear carrier attached to the lower flanges of a hat shaped center sill comprises a flat steel plate to which are connected first and second slide or wear plates which extend substantially the width of the center sill. The slide plates are substantially identical and, in assembling of the carrier, proper assembly is assured since the carrier is reversible and either slide plate will properly support the draft gear.

1 Claim, 4 Drawing Figures

FIG. 1
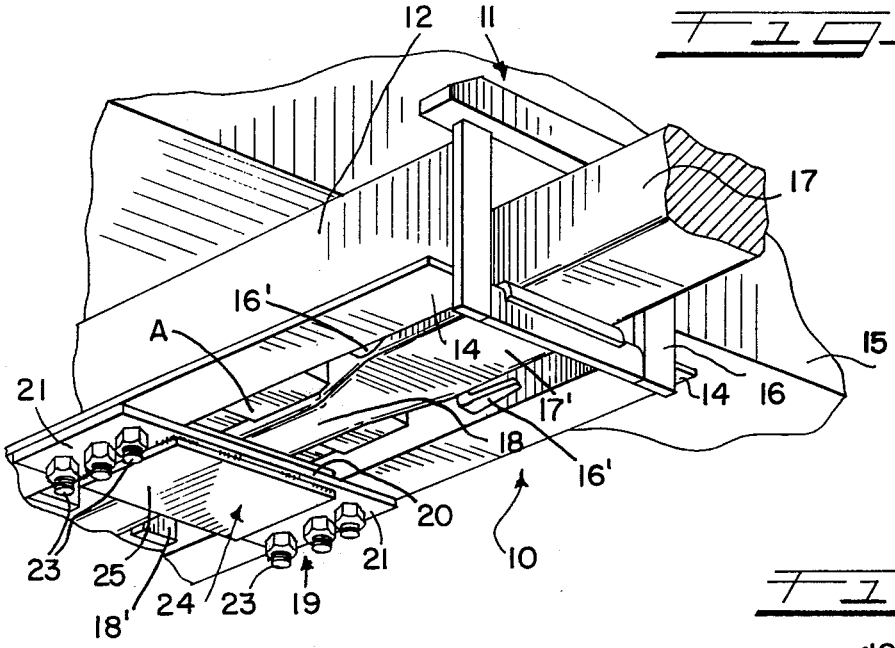
FIG. 2
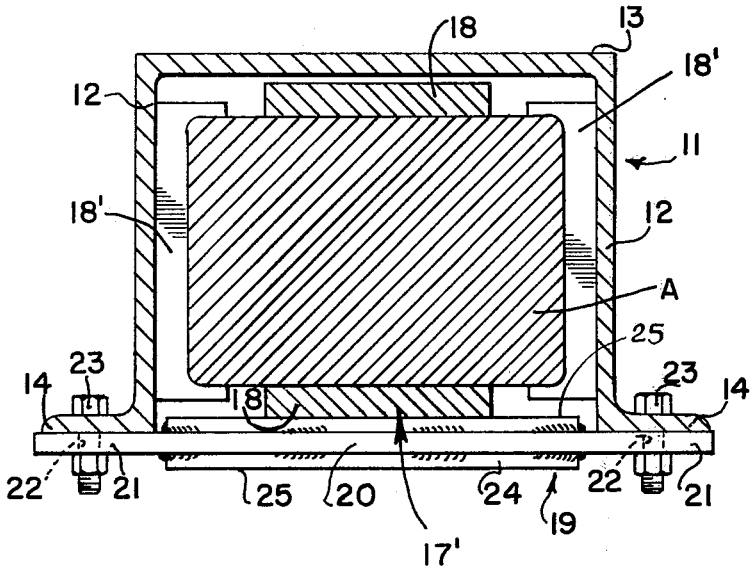
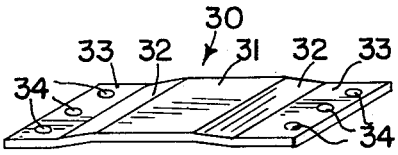
(PRIOR ART)
FIG. 4
FIG. 3
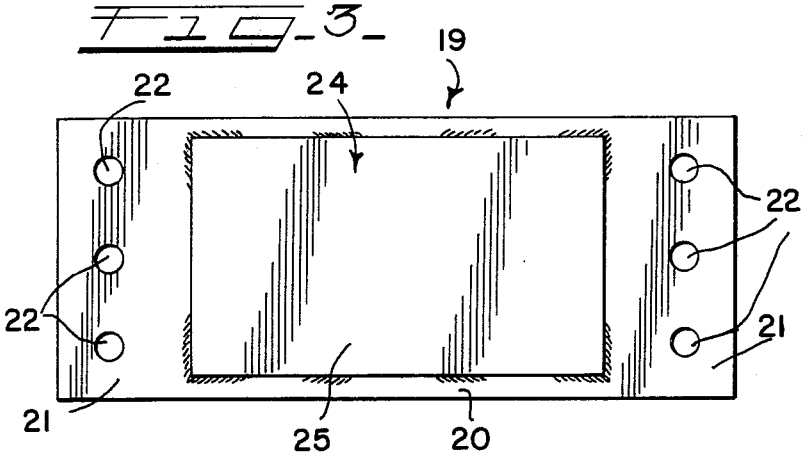

DRAFT GEAR CARRIER FOR RAILWAY CARS

BACKGROUND OF THE INVENTION

1. Field of the Invention

The broad field pertains to railway cars. More specifically it pertains to a draft gear carrier which is attached to opposite ends of a conventional center sill for supporting the draft gear which may include a yoke and coupler connected to an end of car cushion, rubber cushion, or other conventional shock absorbing device.

2. Description of the Prior Art

The prior art is illustrated in U.S. Pat. Nos. 1,065,646, 2,271,907, 2,529,626, 3,378,150, 3,394,821 and RE 14,526. Also the drawing illustrates the conventional prior art carrier in universal use at the present time and which presents operating problems more succinctly described in the following description.

SUMMARY

It is a prime object of the present invention to provide an improved draft gear carrier for railway cars which can be assemblied in the shop or in the field without any opportunity of error occurring since the carrier is reversible and cannot be improperly applied. The present invention consists of a flat plate having outer connector edges with apertures through which bolts are applied for releasably connecting the plate to the lower flange of a conventional hat shaped center sill. The flat plate has upper and lower faces to which are connected first and second slide plates which extend substantially the full width provided by the horizontally spaced vertical walls of the hat shaped center sill. Thus the carrier can be positioned with either of the slide plates in sliding engagement with the draft gear assembly.

BRIEF DESCRIPTION OF THE DRAWINGS

FIG. 1 is an isometric view of one end of a railcar underframe disclosing a draft gear carrier applied to a center sill and portions of a draft gear and the shank of a coupler projecting outwardly with respect thereto;

FIG. 2, is a cross-sectional view of a center sill, coupler shank draft gear and draft gear carrier;

FIG. 3 is an elevational view of a draft gear carrier showing one side thereof with a slide plate connected thereto; and FIG. 4, is a perspective view of a draft gear carrier of the prior art.

DESCRIPTION OF THE PREFERRED EMBODIMENT

A railway car underframe is generally designated by the reference character 10 and includes a longitudinal center sill 11 of hat shaped design including spaced vertical walls 12, a top wall 13 and outwardly extending lower flanges 14. A railway car body is indicated at 15. The center sill at each of its ends is provided with a reinforcing structure 16 forming a mouth through which the shank 17 of a coupler (not shown) projects.

The draft gears or railway cars are generally similar and conventional and are here not shown in detail. Reference may be had to the aforementioned prior art patents which disclose the constitutents of a draft gear. Generally the automatic coupler head includes the shank 17 which at its rear end is connected to a yoke 17' for swinging movement about a vertical axis. The yoke 17' in turn includes yoke straps 18 connected to an end of car cushion, or a rubber draft gear unit A, disclosed or other type of impact cushioning device intended to protect the car structure and loading against excessive speed coupling impacts. The draft gear is adapted to engage rear stops 18' mounted within the center sill 11. Similar front stops 16' are provided, as shown in FIG. 1. Thus the coupler, yoke coupler shank and draft gear A may move longitudinally and the coupler may swing relative to the center sill of the car.

The draft gear A, and yoke straps 18 are supported by the draft gear carrier 19. The carrier 19 comprises a flat plate 20 having end connector portions 21 provided with a plurality of openings 22. Bolt and nut connections 23 extend through suitable apertures (not shown) in flanges 14 for releasably connecting the connector portions 21 to the said flanges.

Identical plates 24 are rigidly connected to the plate 20 on opposite sides thereof and each includes slide or wear faces 25 which may support the draft gear A in sliding relation. The width of the plates 24 is substantially equal to the distances between the vertical walls 12 of the center sill so that the yoke 17' and draft gear A in sliding movement will be fully supported. The carrier of course could also have the equivalent of the base plate 20, plates 24 and slide faces 25 formed integrally by machining or casting, the present arrangement showing the plate 24 connected to the plate 20 by welding or other similar securing process.

FIG. 4, disclosing the prior art shows a carrier 30 having a center raised slide portion 31, downwardly extending diagonal portions 32 and end connector portions 33 provided with attachment openings 34.

THE OPERATION

During train operation the draft gear A, yoke 17' and coupler shank 17 moves longitudinally for limited longitudinal cushioning movement relative to the fixed center sill. The improved draft gear carrier supports the draft gear in the sliding movement.

The present invention is an improvement over the prior art disclosed in FIG. 4 and the disadvantages of the said prior art are as follows:

In the prior art device only one relatively narrow slide surface 31 is provided. By virtue of the diagonal connecting portions 32, the width of the slide surface 31 is limited and excessive wear can occur.

In the present invention the slide surfaces extend almost the entire width of the center sill providing greater slide area.

Use of the prior art has disclosed that such draft gear carriers would be removed and reapplied in the field in upside down fashion causing serious stress failures and requiring extensive maintenance.

In the present invention both sides are used, greater life results and it is immaterial how the carrier is applied since it is completely reversible and cannot be improperly assembled.

The present carrier is stronger and stiffer since the additional slide plates strengthen and reinforce the carrier.

The foregoing drawings and description merely explain and illustrate the invention and the invention is not limited thereto, except insofar as the appended claims are so limited, as those skilled in the art who have the disclosure before them will be able to make modifications and variations therein without departing from the scope of the invention.

What is claimed is:

1. For a railway car having a center sill including a top wall, horizontally spaced vertical side walls and lower connecting means, a draft gear including a yoke reciprocates essentially longitudinally, the improvement comprising:

a draft gear carrier having a substantially flat plate with laterally spaced end connector portions and first and second wear portions offset from opposite sides of the plate, said wear portions each having a length substantially greater than the width of the yoke and extending substantially the length of the spacing between the vertical side walls of the center sill, means for initially releasably connecting the end connector portions to the respective connecting means on the side walls of the center sill with its first wear portion beneath and in engagement with said yoke, said wear portion initially having essentially flat wear surfaces, said yoke at least in the area of engagement with the carrier being narrower than the width of said wear portions, means for restricting movements of the yoke laterally substantially less than the lengths of said wear portions whereby said yoke in operation develops a wear pattern on the first wear portion that forms a transversely arcuate depression essentially centered on the first wear portion and leaving unworn lateral thick edge portions of substantially original thickness on said first wear portion flanking said depression, said carrier being adapted to be reversed to position the second offset wear portion beneath and in engagement with said yoke upon predetermined wear on said first wear portion and disposing said wear portion on the bottom of the carrier with said arcuate depression facing downwardly and defining an upwardly bowed strength-imparting arch-like structure centered between said unworn thick edge portion of the carrier which serve as buttresses for the arch like structure.

* * * * *